US011721288B2

(12) United States Patent
Lai et al.

(10) Patent No.: US 11,721,288 B2
(45) Date of Patent: Aug. 8, 2023

(54) PIXEL CIRCUIT, PIXEL CIRCUIT DRIVING METHOD, DISPLAY PANEL AND DISPLAY APPARATUS

(71) Applicant: Xiamen Tianma Microelectronics Co., Ltd., Xiamen (CN)

(72) Inventors: Qingjun Lai, Xiamen (CN); Yihua Zhu, Xiamen (CN)

(73) Assignee: Xiamen Tianma Microelectronics Co., Ltd., Xiamen (CN)

( * ) Notice: Subject to any disclaimer, the term of this patent is extended or adjusted under 35 U.S.C. 154(b) by 0 days.

(21) Appl. No.: 17/858,492

(22) Filed: Jul. 6, 2022

(65) Prior Publication Data

US 2022/0335897 A1 Oct. 20, 2022

(30) Foreign Application Priority Data

Nov. 30, 2021 (CN) ..... 202111450630.5

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0852* (2013.01); *G09G 2320/0233* (2013.01)

(58) Field of Classification Search
CPC .. G09G 3/3458; G09G 3/3266; G09G 3/3233; G09G 3/3208; G09G 2300/0852; G09G 2300/0819; G09G 2300/0861; G09G 2320/0233; G09G 2320/0238; G09G 2320/0626
See application file for complete search history.

(56) References Cited

U.S. PATENT DOCUMENTS

| | | | | |
|---|---|---|---|---|
| 9,082,346 | B2 * | 7/2015 | Shih | G09G 3/3233 |
| 9,257,074 | B2 * | 2/2016 | Tseng | G09G 3/3233 |
| 9,773,451 | B2 * | 9/2017 | Wu | H10K 59/131 |
| 10,304,378 | B2 * | 5/2019 | Lin | G09G 3/3233 |
| 2007/0030217 | A1 * | 2/2007 | Peng | G09G 3/3233 345/76 |
| 2013/0335391 | A1 * | 12/2013 | Kim | G09G 3/3291 345/76 |

(Continued)

*Primary Examiner* — David Tung
(74) *Attorney, Agent, or Firm* — KDW Firm PLLC

(57) ABSTRACT

In the pixel circuit, first terminal of drive module configured to receive signal output by first power supply, first light emission control module connected between second terminal of drive module and first terminal of light emitting module, and second terminal of light emitting module connected to second power supply; first terminal of first storage module connected to control terminal of drive module, second terminal of first storage module connected to first terminal of second storage module, and second terminal of second storage module connected to first terminal of light emitting module; threshold detection module connected between second terminal of first storage module and second terminal of drive module, and configured to control first storage module to store threshold voltage of drive module; data writing module connected to second terminal of drive module; an initialization module connected to control terminal of drive module and first terminal of light emitting module.

20 Claims, 14 Drawing Sheets

(56) References Cited

U.S. PATENT DOCUMENTS

| | | | | |
|---|---|---|---|---|
| 2015/0154906 | A1* | 6/2015 | Chung | G09G 3/3233 345/212 |
| 2016/0063921 | A1* | 3/2016 | Tsai | G09G 3/3233 345/76 |
| 2016/0351121 | A1* | 12/2016 | Kim | G09G 3/3233 |
| 2016/0351122 | A1* | 12/2016 | Jung | G09G 3/2085 |
| 2017/0092200 | A1* | 3/2017 | Park | G09G 3/3266 |
| 2020/0211452 | A1* | 7/2020 | Lee | G09G 3/325 |

* cited by examiner

PIXEL CIRCUIT, PIXEL CIRCUIT DRIVING METHOD, DISPLAY PANEL AND DISPLAY APPARATUS

CROSS-REFERENCE TO RELATED APPLICATION

This application claims priority to Chinese Patent Application No. 202111450630.5 filed on Nov. 30, 2021, the disclosure of which is incorporated herein by reference in its entirety.

FIELD

This disclosure relates to the field of display technologies, and in particular to a pixel circuit, a pixel circuit driving method, a display panel, and a display apparatus.

BACKGROUND

In a pixel driving circuit in an organic light-emitting diode (OLED) display, a display function is implemented by that a drive transistor controls a drive current flowing through the OLED. A magnitude of the drive current is related to characteristic parameters, including a threshold voltage, of the drive transistor.

Currently, in a driving process of a drive transistor, a threshold voltage is applied to a gate of a drive transistor during data voltage writing to realize compensation for the threshold voltage. However, conventional drive transistors, in particular, the conventional drive transistors having indium gallium zinc oxide (IGZO) as a material for a channel layer, suffer from an issue that compensated threshold voltages are different under different data voltages, resulting in currents transmitted by the drive transistor being different in a certain degree, and causing a certain deviation in display luminance of the display panel.

SUMMARY

A pixel circuit, a pixel circuit driving method, a display panel, and a display apparatus are provided according to embodiments of the present disclosure to reduce luminance deviation of a display panel.

In a first aspect, it is provided according to embodiments of the present disclosure a pixel circuit, which includes a data writing module, a drive module, a first storage module, a second storage module, a threshold detection module, a first light emission control module, an initialization module and a light emitting module.

A first terminal of the drive module is configured to receive a signal output from the first power supply PVDD, the first light emission control module is connected between a second terminal of the drive module and a first terminal of the light emitting module, and a second terminal of the light emitting module is connected to a second power supply; and the drive module is configured to provide a light mission drive signal to the light emitting module.

A first terminal of the first storage module is connected to a control terminal of the drive module, a second terminal of the first storage module is connected to a first terminal of the second storage module, and a second terminal of the second storage module is connected to the first terminal of the light emitting module.

The threshold detection module is connected between a second terminal of the first storage module and a second terminal of the drive module, and the threshold detection module is configured to control the first storage module to store a threshold voltage of the drive module.

The data writing module is connected to the second terminal of the drive module, and is configured to transmit a data voltage to the drive module.

The initialization module is connected to the control terminal of the drive module and the first terminal of the light emitting module, and the initialization module is configured to transmit a corresponding initialization voltage to the control terminal of the drive module and the first terminal of the light emitting module.

In a second aspect, it is further provided according to embodiments of the present disclosure a pixel circuit driving method, applied to the pixel circuit according to any embodiment of the present disclosure, includes as follows.

In an initialization stage, the initialization module is controlled to transmit a corresponding initialization voltage to the control terminal of the drive module and the first terminal of the light emitting module.

In a threshold compensation stage, the threshold detection module is controlled to turn on and the first storage module is controlled to store a threshold voltage of the drive module.

In a data writing stage, the data writing module is controlled to write a data voltage into the second terminal of the drive module; and the second storage module is controlled to store the data voltage.

In a light emitting stage, the first light emission control module is controlled to turn on, and the drive module is controlled to output a drive current to drive the light emitting module to emit light.

In a third aspect, it is further provided according to embodiments of the present disclosure a display panel, which includes a pixel circuit, and the pixel circuit includes a data writing module, a drive module, a first storage module, a second storage module, a threshold detection module, a first light emission control module, an initialization module and a light emitting module.

A first terminal of the drive module is configured to receive a signal output from the first power supply PVDD, the first light emission control module is connected between a second terminal of the drive module and a first terminal of the light emitting module, and a second terminal of the light emitting module is connected to a second power supply; and the drive module is configured to provide a light mission drive signal to the light emitting module. A first terminal of the first storage module is connected to a control terminal of the drive module, a second terminal of the first storage module is connected to a first terminal of the second storage module, and a second terminal of the second storage module is connected to the first terminal of the light emitting module. The threshold detection module is connected between a second terminal of the first storage module and a second terminal of the drive module, and the threshold detection module is configured to control the first storage module to store a threshold voltage of the drive module. The data writing module is connected to the second terminal of the drive module, and is configured to transmit a data voltage to the drive module. The initialization module is connected to the control terminal of the drive module and the first terminal of the light emitting module, and the initialization module is configured to transmit a corresponding initialization voltage to the control terminal of the drive module and the first terminal of the light emitting module.

In a fourth aspect, it is further provided according to embodiments of the present disclosure a display apparatus, which includes a display panel including a pixel circuit, and the pixel circuit includes a data writing module, a drive module, a first storage module, a second storage module, a threshold detection module, a first light emission control module, an initialization module and a light emitting module.

A first terminal of the drive module is configured to receive a signal output from the first power supply PVDD, the first light emission control module is connected between a second terminal of the drive module and a first terminal of the light emitting module, and a second terminal of the light emitting module is connected to a second power supply; and the drive module is configured to provide a light mission drive signal to the light emitting module. A first terminal of the first storage module is connected to a control terminal of the drive module, a second terminal of the first storage module is connected to a first terminal of the second storage module, and a second terminal of the second storage module is connected to the first terminal of the light emitting module. The threshold detection module is connected between a second terminal of the first storage module and a second terminal of the drive module, and the threshold detection module is configured to control the first storage module to store a threshold voltage of the drive module. The data writing module is connected to the second terminal of the drive module, and is configured to transmit a data voltage to the drive module. The initialization module is connected to the control terminal of the drive module and the first terminal of the light emitting module, and the initialization module is configured to transmit a corresponding initialization voltage to the control terminal of the drive module and the first terminal of the light emitting module.

DETAILED DESCRIPTION

Figure 1:
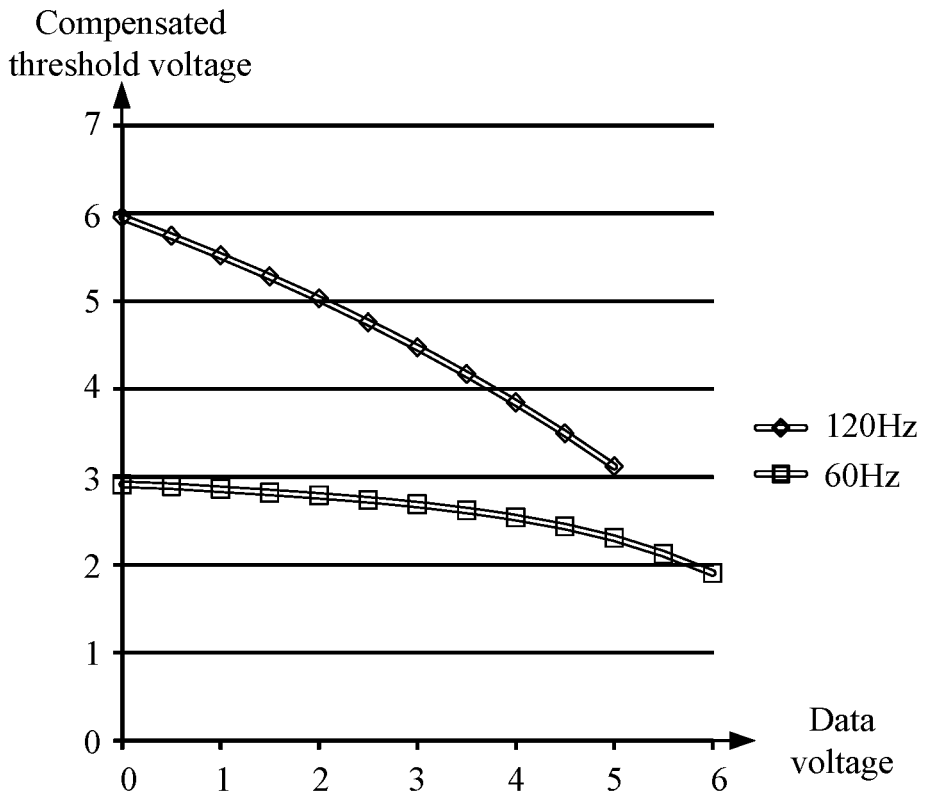
FIG. 1 is a graph of compensated threshold voltage-data voltage for an N-type drive transistor having an IGZO as a channel layer in the related art.

The present disclosure is further described hereinafter in detail in conjunction with drawings and embodiments. It is to be understood that the embodiments set forth below are intended to illustrate rather than limiting the present disclosure. Additionally, it is to be noted that, for ease of description, only part of the structures related to the present disclosure rather than all of the structures is illustrated in the drawings.

Figure 2:
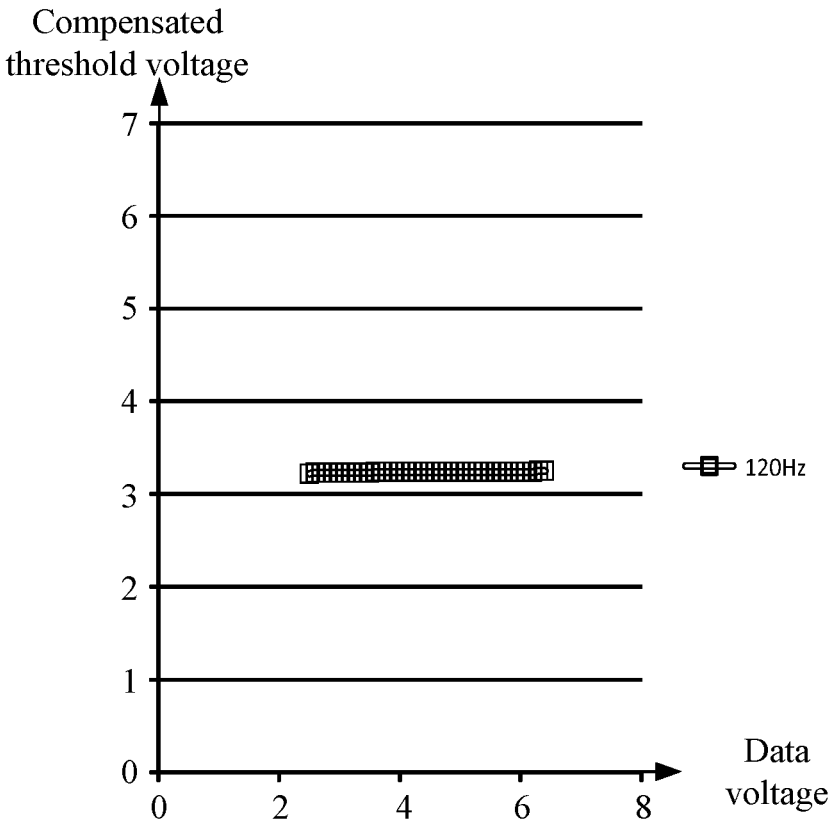
FIG. 2 is a graph of compensated threshold voltage-data voltage for a P-type drive transistor having low temperature poly-silicon (LTPS) as a channel layer in the related art.

It can be known that, in a case where an N-type drive transistor having an indium gallium zinc oxide (IGZO) as a material for channel layer is used to form a pixel circuit, there is an issue that the driving capacity of the N-type drive transistor is insufficient. Specifically, in the process of implementing solutions of the embodiments of the present disclosure, when a same gate signal is input to gates of an N-type drive transistor having an IGZO as a channel layer and is input to a P-type drive transistor having LTPS as channel layer, the on-current of the N-type drive transistor having IGZO as channel layer is relatively small. Further, as shown in FIG. 1, FIG. 1 is a graph of compensated threshold voltage-data voltage for an N-type drive transistor having IGZO as a channel layer in the related art, and FIG. 2 is a graph of compensated threshold voltage-data voltage for a P-type drive transistor having LTPS as channel layer in the related art. Referring to FIG. 1, FIG. 1 shows graphs of compensated threshold voltage-data voltage at scanning frequencies of 120 hertz (Hz) and 60 Hz. It can be seen that, whether at 120 Hz or 60 Hz, compensated threshold voltages corresponding to different data voltages are different, and as the scanning frequency is higher, the difference between compensated threshold voltages corresponding to different data voltages is greater, resulting in a large display luminance deviation, which shows that the threshold compensation to the N-type drive transistor having IGZO as channel layer is slow, and that the threshold voltage cannot be fully compensated in a short time. FIG. 2 shows a graph of compensated threshold voltage-data voltage at a scanning frequency of 60 Hz, in which, compensated threshold voltages corresponding to different data voltages are substantially the same, leading to good display uniformity, which shows that the threshold compensation to the P-type drive transistor having LTPS as channel layer is fast. It can be known accordingly that, the driving capability of the N-type drive transistor having IGZO as channel layer is insufficient. However, since the N-type drive transistor having IGZO as channel layer can achieve a panel with high-resolution and have a low cost and a wide prospect, the following solutions are provided to address the issue of luminance deviation caused by the N-type drive transistor having IGZO as channel layer.

A pixel circuit is provided according to embodiments of the present disclosure, which includes a data writing module, a drive module, a first storage module, a second storage module, a threshold detection module, a first light emission control module, an initialization module and a light emitting module.

A first terminal of the drive module is configured to receive a signal output from the first power supply PVDD, the first light emission control module is connected between a second terminal of the drive module and a first terminal of the light emitting module, and a second terminal of the light emitting module is connected to a second power supply; the drive module is configured to provide a light mission drive signal to the light emitting module.

A first terminal of the first storage module is connected to a control terminal of the drive module, a second terminal of the first storage module is connected to a first terminal of the second storage module, and a second terminal of the second storage module is connected to the first terminal of the light emitting module.

The threshold detection module is connected between the second terminal of the first storage module and the second terminal of the drive module, and is configured to control the first storage module to store a threshold voltage of the drive module.

The data writing module is connected to the second terminal of the drive module, and is configured to transmit a data voltage to the drive module.

The initialization module is connected to the control terminal of the drive module and the first terminal of the light emitting module, and the initialization module is configured to transmit a corresponding initialization voltage to the control terminal of the drive module and the first terminal of the light emitting module.

In embodiments of the present disclosure, the drive module is connected to the first power supply and the first terminal of the light emitting module via the first light emission control module, and the second terminal of the light emitting module is connected to the second power supply, so that the drive module provides a light emission drive signal for the light emitting module; the initialization module is configured to provide corresponding initialization voltages to the control terminal of the drive module and the first terminal of the light emitting module; the first storage module is connected to the control terminal of the drive module, and is connected to the second terminal of the drive module via the threshold detection module, and can store the threshold voltage of the drive module before the data voltage is written into the drive module; the data writing module is connected to the second terminal of the drive module, and is configured to transmit the data voltage to the drive module; the second storage module is connected to each of the first storage unit module and the first terminal of the light emitting module, and is configured to store the data voltage of the drive module. In the present embodiments, the first storage module can store the threshold voltage before the data voltage is written into the drive module, so as to compensate the threshold voltage for the drive module in advance. In addition, the threshold voltage is kept being compensated while the data voltage is written into the drive module, and thus, a duration of compensation for the threshold voltage is effectively prolonged, the compensation effect is improved, the issue of different degrees of compensation for the threshold voltage between different pixels is effectively avoided, the drive module is prevented from transmitting different currents to the light emitting modules, thereby improving a uniformity of the display luminance of the entire display panel, and reducing the luminance deviation.

Hereinafter, the technical solutions in the embodiments of the present disclosure are described clearly and completely in conjunction with drawings in the embodiments of the present disclosure. Based on the embodiments of the present disclosure, all other embodiments obtained by those skilled in the art without creative efforts fall within the scope of protection of the present disclosure.

Figure 3:
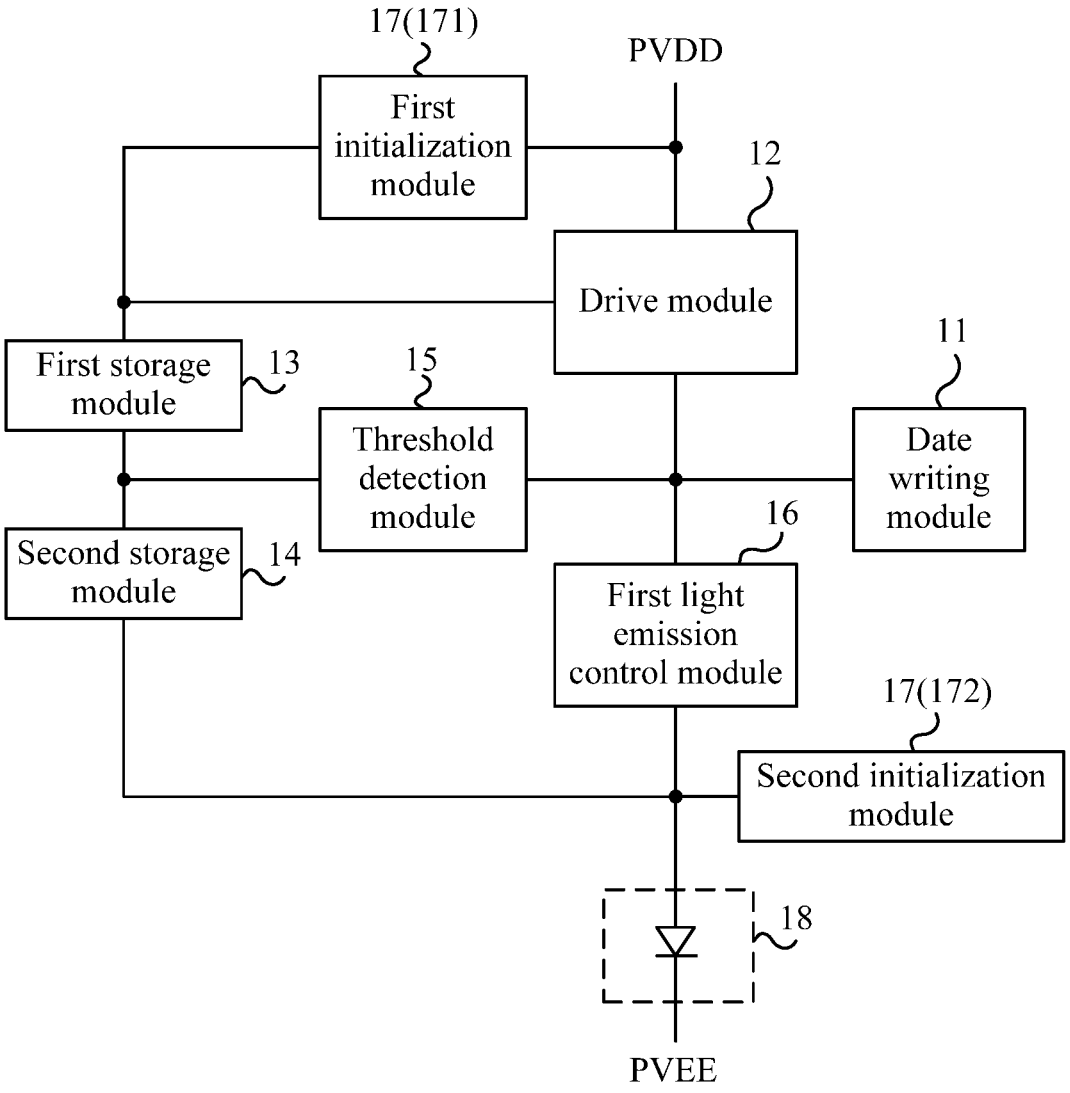
FIG. 3 is a schematic structural diagram of a pixel circuit according to an embodiment of the present disclosure.

FIG. 3 is a schematic structural diagram of a pixel circuit according to an embodiment of the present disclosure. As shown in FIG. 3, the pixel circuit includes a data writing module 11, a drive module 12, a first storage module 13, a second storage module 14, a threshold detection module 15, a first light emission control module 16, an initialization module 17 and a light emitting module 18. A first terminal of the drive module 12 is configured to receive a signal output from the first power supply PVDD. The first light emission control module 16 is connected between a second terminal of the drive module 12 and a first terminal of the light emitting module 18. A second terminal of the light emitting module 18 is connected to a second power supply PVEE. That is, the signal output from the first power supply PVDD to the first terminal of the light-emitting module 18 through the drive module 12 and the first light emission control module 16 sequentially, such that the drive module 12 provides a light emission drive signal to the light emitting module 18.

A first terminal of the first storage module 13 is connected to a control terminal of the drive module 12, and a second terminal of the first storage module 13 is connected to the second terminal of the drive module 12 via the threshold detection module 15, such that the first storage module 13 can store a threshold voltage Vth of the drive module 12, a first terminal of the second storage module 14 is connected to the second terminal of the first storage module 13, a second terminal of the second storage module 14 is connected to the first terminal of the light emitting module 18, and the data writing module 11 is connected to the second terminal of the drive module 12, such that the data writing module 11 can transmit a data voltage Data to the drive module 12, and the data voltage is stored by the second storage module 14, such that the voltage at the control terminal of the drive module 12 finally reaches Vth+Data, such that the current output from the drive module 12 to the light emitting module 17 is only related to the magnitude of the data voltage Data, thereby avoiding deviation of the output current of the pixel circuit and improving the display effect of the display panel.

It should be noted that the threshold voltage Vth stored in the first storage module 13 is independent of the data voltage Data, and the compensation for the threshold voltage Vth can be performed before the data voltage Data is written, such that even if the compensation for the N-type drive transistor having IGZO as channel layer is slow, the compensation to the N-type drive transistor can be completed by lengthening the compensation time, thereby effectively avoiding the difference between the threshold voltages compensated by the drive modules 12 of the pixel circuits and avoiding the display deviation of the display panel.

Further, the initialization module 17 can be connected to each of the control terminal of the drive module 12 and the first terminal of the light emitting module 18, so as to input a corresponding initialization voltage to the control terminal of the drive module 12 and input a corresponding initialization voltage to the first terminal of the light emitting module 18 at a stage of initialization of the pixel circuit.

With continued reference to FIG. 3, in some embodiments, the initialization module may include a first initialization module 171 and a second initialization module 172. The first initialization module 171 is connected between the first power supply PVDD and the first terminal of the first storage module 13, for providing a first initialization voltage to the first storage module 13. The second initialization module 172 is connected between a reference voltage VAR and the first terminal of the light emitting module 18, for providing a second initialization voltage to the light emitting module 18 and the second terminal of the drive module 12.

In order to prevent the voltage of the control terminal of the drive module 12 in a previous frame scanning period from adversely affecting the voltage of the first terminal of the first storage module 13 in a current frame scanning period, the first initialization module 171 is provided according to the present embodiments of the present application. The first initialization module 171 can provide the first initialization voltage to the first terminal of the first storage module 13 and the control terminal of the drive module 12 at the initial time of the current frame scanning period. In the present embodiments, the first initialization voltage is the voltage output from the first power supply PVDD. Similarly, in order to prevent a residual voltage at the first terminal of the light emitting module 18 in a previous frame scanning period from causing a current leakage in the light emitting module 18 and adversely affecting the display luminance of the light emitting module 18 in the current frame scanning period, the second initialization module 172 is provided according to the present embodiments. The second initialization module 172 is connected to the reference voltage VAR and the first terminal of the light emitting module 18, and is configured to provide a second initialization voltage for the first terminal of the light emitting module 18 and the second terminal of the drive module 12. The second initialization voltage is a signal output from the reference voltage VAR. The arrangement of the above first initialization module 171 and second initialization module 172 can prevent the light emitting module 18 in the current frame scanning period from being adversely affected by the previous frame scanning period, further improving the display uniformity of the display panel.

With continued reference to FIG. 3, in some embodiments, the first terminal of the drive module 12 may be directly connected to the first power supply PVDD.

In some embodiments, a control terminal of the data writing module 11 may be connected to a first scanning line S1; a control terminal of the second initialization module 172 may be connected to a second scanning line S2; a control terminal of the first light emission control module 16 may be connected to a light emission control signal line EMIT; a control terminal of the first initialization module 171 may be connected to a third scanning line Sn1; and a control terminal of the threshold detection module 15 may be connected to a fourth scanning line Sn2.

For the pixel circuit in the present embodiments, the display panel is further provided with a gate drive circuit corresponding to the pixel circuit. Multiple gate drive circuits are disposed sequentially, each gate drive circuit corresponds to one row of pixel circuits, and each gate drive circuit is capable of outputting the first scanning line S1, the second scanning line S2, the third scanning line Sn1, and the fourth scanning line Sn2. The data writing module 11 may be controlled by the first scanning line S1 to be turned on and off, the second initialization module 172 may be controlled by the second scanning line S2 to be turned on and off. The first light emission control module 16 may be controlled by the light emission control signal line EMIT to be turned on and off, the first initialization module 171 may be controlled by the third scanning line Sn1 to be turned on and off, and the threshold detection module 15 is controlled by the fourth scanning line Sn2 to be turned on and off. The signals output from the first scanning line S1, the second scanning line S2, the third scanning line Sn1, and the fourth scanning line Sn2 are configured independently and do not interfere with each other, so that efficient and various operation timing sequences can be provided for the pixel circuits.

Figure 4:
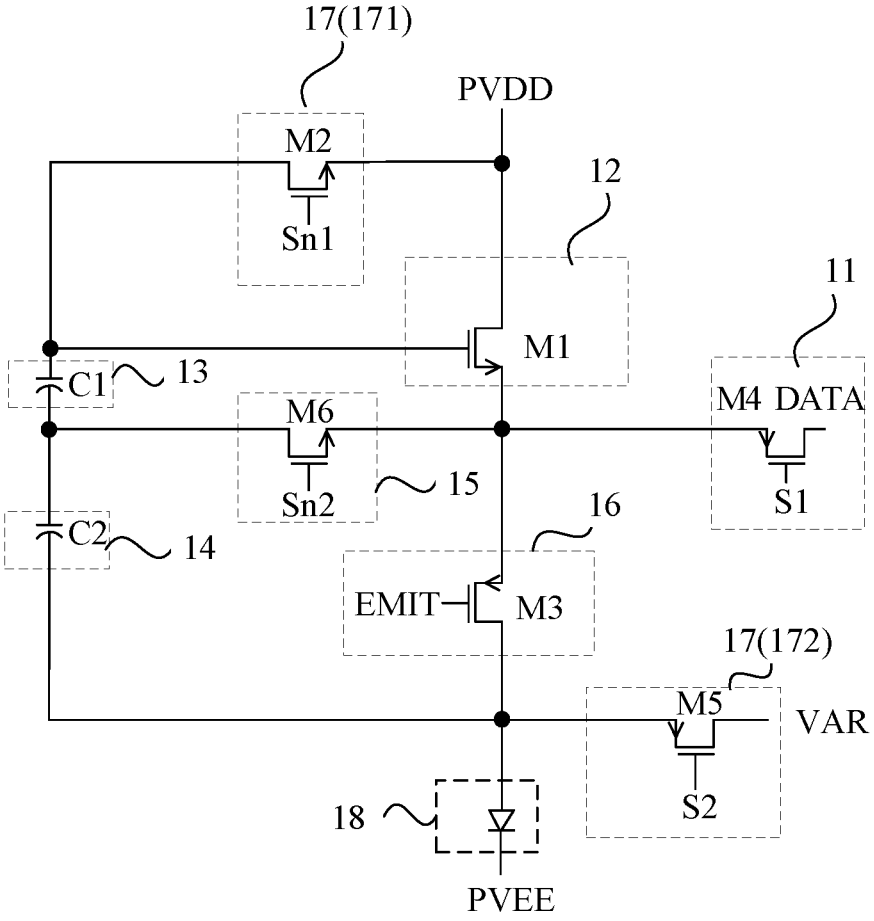
FIG. 4 is another schematic structural diagram of a pixel circuit according to an embodiment of the present disclosure.

FIG. 4 is another schematic structural diagram of a pixel circuit according to an embodiment of the present disclosure. In some embodiments, the drive module 12 includes a first transistor M1; the first initialization module 171 includes a second transistor M2; the first light emission control module 16 includes a third transistor M3; the data writing module 11 includes a fourth transistor M4; the second initialization module 172 includes a fifth transistor M5; the threshold detection module 15 includes a sixth transistor M6; the first storage module 13 includes a first capacitor C1; the second storage module includes a second capacitor C2. A control terminal of the first transistor M1 is electrically connected to each of a second terminal of the second transistor M2 and a first terminal of the first capacitor C1; a first terminal of the first transistor M1 is configured to receive a signal output from the first power supply PVDD; a second terminal of the first transistor M1 is connected to each of a second terminal of the sixth transistor M6, a first terminal of the third transistor M3 and a second terminal of the fourth transistor M4. A first terminal of the second transistor M2 is configured to receive a signal output from the first power supply PVDD; a control terminal of the second transistor M2 is connected to a third scanning line Sn1; a second terminal of the first capacitor C1 is electrically connected to a first terminal of the sixth transistor M6; a control terminal of the sixth transistor M6 is connected to a fourth scanning line Sn2. A first terminal of the fourth transistor M4 is connected to a data signal line; a control terminal of the fourth transistor M4 is connected to a first scanning line S1; a second terminal of the third transistor M3 is connected to the first terminal of the light emitting module 18; a control terminal of the third transistor M3 is connected to a light emission control signal line EMIT; a first terminal of the fifth transistor M5 is connected to a signal line of the reference voltage VAR; a second terminal of the fifth transistor M5 is connected to the first terminal of the light emitting module 18; a control terminal of the fifth transistor M5 is connected to a second scanning line S2. A first terminal of the second capacitor C2 is connected to the second terminal of the first capacitor C1; and a second terminal of the second capacitor C2 is connected to the first terminal of the light emitting module 18.

FIG. 4 shows a specific structural diagram of the pixel circuit. It can be known that the pixel circuit includes the first transistor M1, the second transistor M2, the third transistor M3, the fourth transistor M4, the fifth transistor M5, the sixth transistor M6, the first capacitor C1 and the second capacitor C2. The above components constitute a pixel circuit of 7T2C. The first transistor M1 is a drive transistor for providing a light emission drive signal for the light emitting module 18. The first terminal of the first transistor M1 is connected to the first power supply PVDD. The second terminal of the first transistor M1 is connected to the first terminal of the light emitting module 18 via the third transistor M3. The first terminal of the second transistor M2 is connected to the first power supply PVDD. The second terminal of the second transistor M2 is connected to each of the first terminal of the first capacitor C1 and the control terminal of the first transistor M1. The second terminal of the first capacitor C1 is connected to the second terminal of the first transistor M1 via the sixth transistor M6. The first terminal of the second capacitor C2 is connected to the second terminal of the first capacitor C1, and the second terminal of the second capacitor C2 is connected to the first terminal of the light-emitting module 18. The fourth transistor M4 is connected between the data signal line and the second terminal of the first transistor M1, and the fifth transistor M5 is connected between a reference voltage signal line and the first terminal of the light-emitting module 18. In addition, the control terminal of the second transistor M2 is controlled by the third scanning line Sn1, the control terminal of the sixth transistor M6 is controlled by the fourth scanning line Sn2, the fourth transistor M4 is controlled by the first scanning line S1, and the fifth transistor M5 is controlled by the second scanning line S2. The above pixel circuit uses two storage capacitors: the first capacitor C1 and the second capacitor C2. The first capacitor C1 can separately compensate the threshold voltage of the first transistor M1, and the second capacitor C2 is configured to compensate the data signal Data. Before the data signal is written into the second terminal of the first transistor M1, the first capacitor C1 can compensate the threshold voltage of the first transistor M1, and continue to compensate the threshold voltage of the first transistor M1 after the data is written into the second terminal of the first transistor M1. Thus, the time of compensation performed by the first capacitor C1 to the threshold voltage is prolonged, which ensures the effect of compensation for the threshold voltage of the first transistor M1, and effectively reduces the luminance deviation of the display panel.

In some embodiments, with continued reference to FIG. 4, the first transistor M1, the second transistor M2 and the sixth transistor M6 are N-type transistors; the fourth transistor M4, the fifth transistor M5 and the third transistor M3 are P-type transistors. In a manufacturing process of the display panel, a conventional N-type transistor uses the IGZO as a channel layer, and a conventional P-type transistor uses the LTPS as a channel layer. In the present embodiments, since the N-type transistor can achieve high-resolution display and have a low cost, the first transistor M1, the second transistor M2, and the sixth transistor M6 are provided as N-type transistors, and the issue of slow threshold compensation speed of the N-type transistor is addressed by the first capacitor C1 and the second capacitor C2, thereby effectively implementing a pixel circuit having strong uniformity. In addition, in order to improve the speed of data writing, light emission control, and light emitting module initialization in the pixel circuit, the fourth transistor M4, the fifth transistor M5, and the third transistor M3 are provided as P-type transistors.

Figure 5:
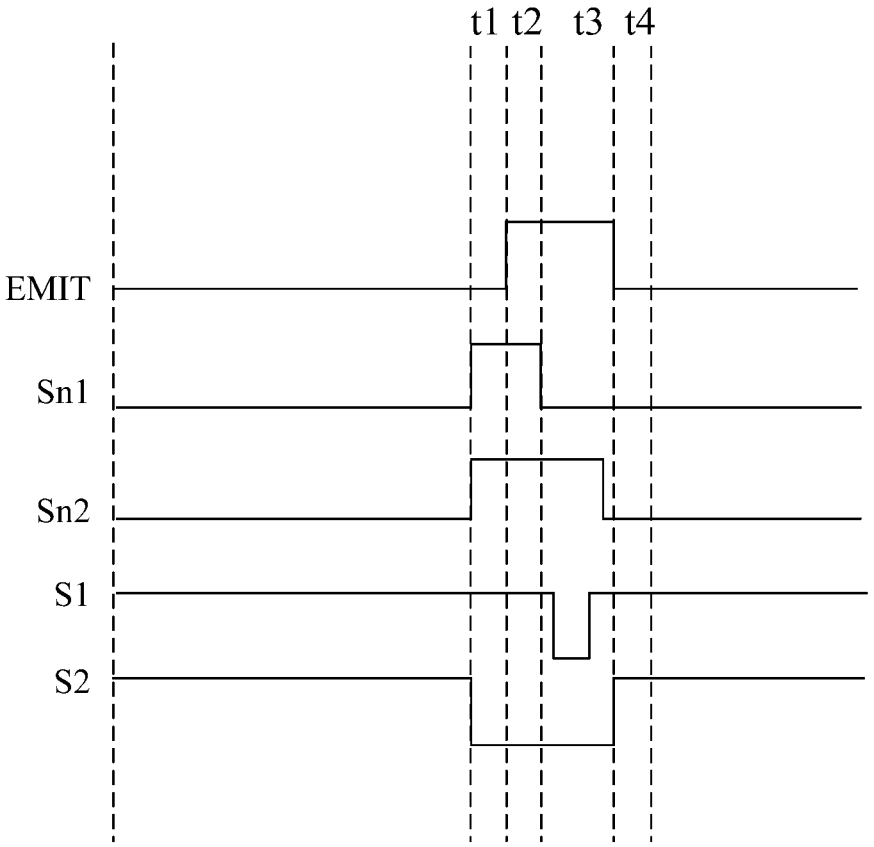
FIG. 5 is a schematic diagram of an operation timing sequence of the pixel circuit of FIG. 4 in one frame period.

As shown in FIG. 5, FIG. 5 is a schematic diagram of an operation timing sequence of the pixel circuit of FIG. 4 in one frame period. On the basis of the above-described embodiment, in one frame period, a pulse of a signal transmitted on the first scanning line S1, a pulse of a signal transmitted on the light emission control signal line EMIT, a pulse of a signal transmitted on the third scanning line Sn1, and a pulse of a signal transmitted on the fourth scanning line Sn2 are all within a time interval of a pulse of a signal transmitted on the second scanning line S2. In one frame period, the pulses of signals of the first scanning line S1, the light emission control signal line EMIT, the third scanning line Sn1 and the fourth scanning line Sn2 are all within the time interval of the pulse of signal of the second scanning line S2, thereby ensuring that before the first transistor M1 outputs the light emission drive signal to the light emitting module 18, the second scanning line S2 keeps outputting the second initialization voltage to the light emitting module 18, keeping the first terminal of the light emitting module 18 at the reset voltage, and preventing the first scanning line S1, the light emission control signal line EMIT, the third scanning line Sn1 and the fourth scanning line Sn2 from causing adverse effects on the voltage at the first terminal of the light emitting module 18 in the process of control, so that the light emission luminance of the light emitting module 18 is only related to the data signal, thereby improving the display accuracy of the light emitting module 18, and preventing display deviation of the display panel.

Figure 6:
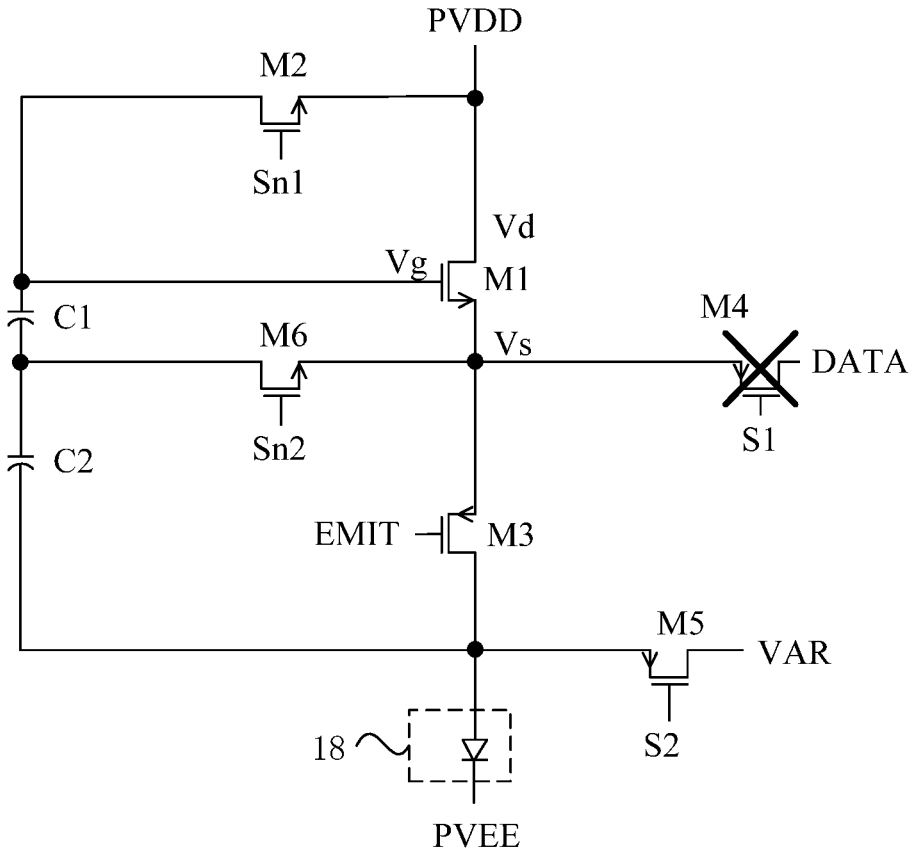
FIG. 6 is a schematic diagram of a pixel circuit in an initialization stage according to an embodiment of the present disclosure.
Figure 7:
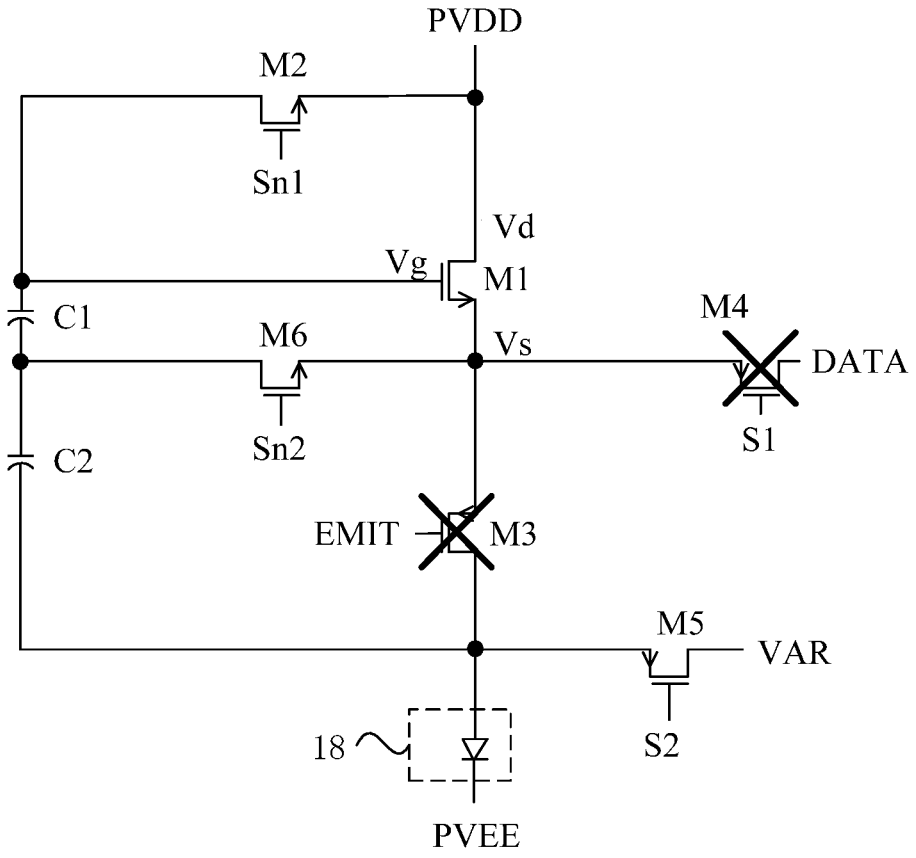
FIG. 7 is a schematic diagram of the pixel circuit in a threshold compensation stage according to an embodiment of the present disclosure.
Figure 8:
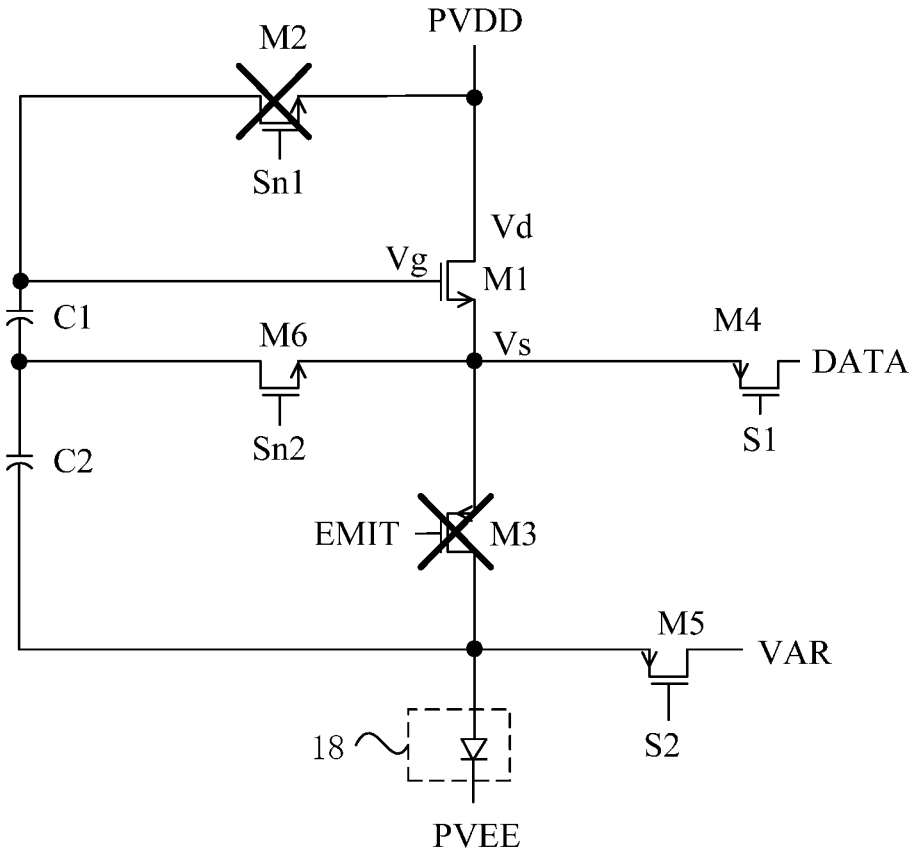
FIG. 8. is a schematic diagram of the pixel circuit in a data writing stage according to an embodiment of the present disclosure.
Figure 9:
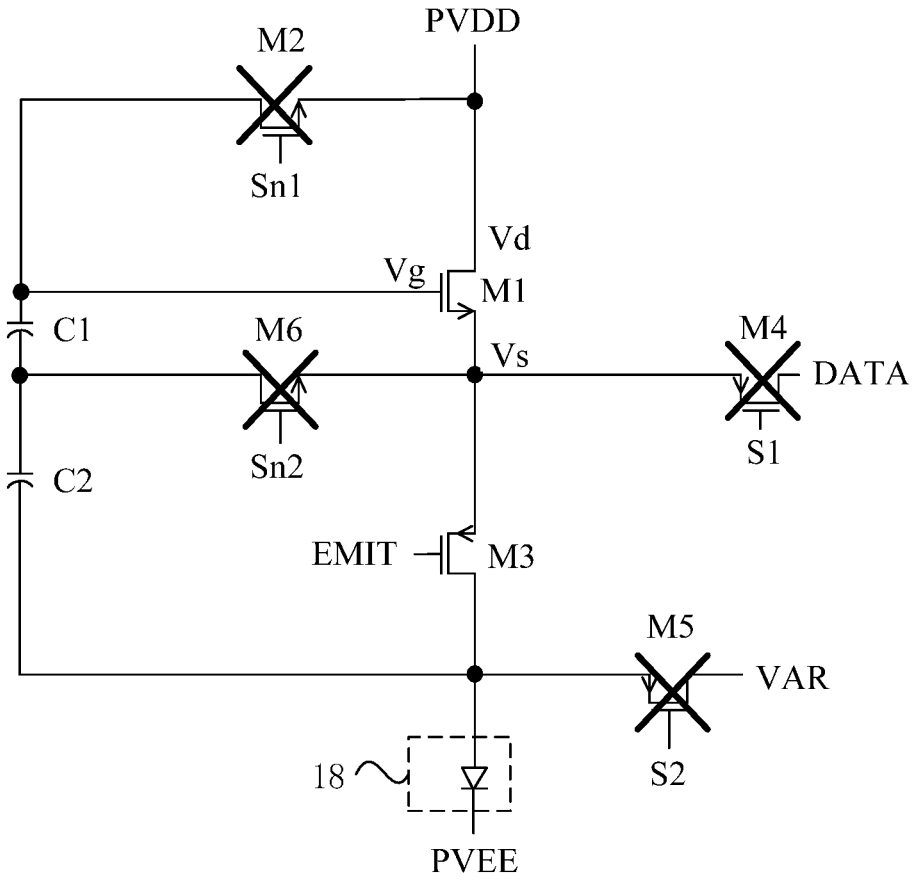
FIG. 9 is a schematic diagram of the pixel circuit in a light-emitting stage according to an embodiment of the present disclosure.

The driving process of the pixel circuit is divided into four stages: an initialization stage, a threshold compensation stage, a data writing stage, and a light emitting stage. FIG. 6 is a schematic diagram of a pixel circuit in the initialization stage according to an embodiment of the present disclosure; FIG. 7 is a schematic diagram of the pixel circuit in the threshold compensation stage according to an embodiment of the present disclosure; FIG. 8. is a schematic diagram of the pixel circuit in the data writing stage according to an embodiment of the present disclosure; and FIG. 9 is a schematic diagram of the pixel circuit in the light-emitting stage according to an embodiment of the present disclosure. Referring to FIG. 5 to FIG. 9, in some embodiments, the first scanning line S1, the second scanning line S2, the third scanning line Sn1, and the fourth scanning line Sn2 are configured to implement driving as follows.

In the initialization stage t1, the first transistor M1, the second transistor M2, the third transistor M3, the fifth transistor M5, and the sixth transistor M6 are turned on; and the fourth transistor M4 is turned off; in the threshold compensation stage t2, the first transistor M1, the second transistor M2, the fifth transistor M5, and the sixth transistor M6 are turned on; the third transistor M3 and the fourth transistor M4 are turned off; in the data writing stage t3, the first transistor M1, the fourth transistor M4, the fifth transistor M5, and the sixth transistor M6 are turned on; the second transistor M2 and the third transistor M3 are turned off; and in the light emitting stage t4, the first transistor M1 and the third transistor M3 are turned on, and the second transistor M2, the fourth transistor M4, the fifth transistor M5, and the sixth transistor M6 are turned off.

In particular, it should be noted that in FIG. 6 to FIG. 9, a turned-off transistor is marked by a symbol "X". As shown in FIG. 6, in the initialization stage t1, the first transistor M1 is turned on, the first terminal of the first transistor M1 has a potential Vd satisfying Vd=PVDD (an output voltage of the first power supply), the second transistor M2 is turned on, the control terminal of the first transistor M1 has a potential Vg satisfying Vg=PVDD, the first terminal of the first capacitor C1 has a potential being PVDD, the third transistor M3, the fifth transistor M5, and the sixth transistor M6 are turned on, the fourth transistor M4 is turned off, the second terminal of the first transistor M1 has a potential Vs satisfying Vs=VAR (a voltage value of the reference voltage), and the first terminal of the light emitting module 18 also has a potential being the reference voltage, it can be known accordingly, the potential between the control terminal of the first transistor M1 and the second terminal of the first transistor M1 is Vgs satisfying Vgs=PVDD-VAR.

In the threshold compensation stage t2, the third transistor M3 is turned off after being turned on, thus the potential of the first terminal of the light-emitting module 18 is maintained as the reference voltage, the first capacitor C1, the first transistor M1 and the sixth transistor M6 form a discharge loop, the first capacitor C1 is gradually discharged until the potential Vgs between the control terminal and the second terminal of the first transistor M1 meets Vgs=Vth (the threshold voltage). In this case, the potential Vg of the control terminal of the first transistor M1 meets Vg=PVDD, and the potential Vs of the second terminal of the first transistor M1 meets Vs=PVDD-Vth. In addition, the potential of the first terminal of the first capacitor C1 is PVDD, and the potential difference Vc1 between the two terminals of the first capacitor C1 meets Vc1=Vth, thus, in the threshold compensation stage t2, the first capacitor C1 can store the threshold voltage of the first transistor M1, so as to compensate the first transistor M1.

In the data writing stage t3, if the second transistor M2 is turned off after being turned on and the fourth transistor M4 is turned on after being turned off, then the data voltage Data is written into the second terminal of the first transistor M1, the potential Vs of the second terminal of the first transistor M1 meets Vs=Data, the potential Vd of the first terminal of the first transistor M1 meets Vd=PVDD. Since the potential Vgs between the control terminal of the first transistor M1 and the second terminal of the first transistor M1 meets Vgs=Vth, the potential Vg of the control terminal of the first transistor M1 meets Vg=Data+Vth. In this case, the difference Vc1 between potentials of the two terminals of the first capacitor C1 meets Vc1=Vth, and the difference Vc2 between potentials of the two terminals of the second capacitor C2 meets Vc2=Data-VAR. Then, in the data writing stage t3, the first capacitor C1 continues to compensate the threshold voltage of the first transistor M1, and the second capacitor C2 is configured to store the Vc2, thereby ensuring that the first terminal of the second capacitor C2 stores the data voltage Data.

In the light emitting stage t4, the third transistor M3 is turned on after being turned off, the sixth transistor M6 is turned off after being turned on, the fourth transistor M4 is turned off after being turned on, and the fifth transistor M5 is turned off after being turned on. Since the voltage difference between the two terminals of each of the first capacitor C1 and the second capacitor C2 remains constant, the potential difference Vc1 between the two terminals of the first capacitor C1 meets Vc1=Vth, and the potential difference Vc2 between the two terminals of the second capacitor C2 meets Vc2=Data-VAR, the potential Vd of the first terminal of the first transistor M1 meets Vd=PVDD, the potential Vs of the second terminal of the first transistor M1 meets Vs=PVEE (the output voltage of the second power supply)+Voled (a voltage difference of the light-emitting module), the potential Vg of the control terminal of the first transistor M1 meets Vg=Vs+Vc2+Vc1=Data+Vth+PVEE+Voled−VAR, and the potential Vgs between the control terminal of the first transistor M1 and the second terminal of the first transistor M1 meets Vgs=Data+Vth−VAR.

For the initialization stage, the threshold compensation stage, the data writing stage, and the light-emitting stage configured sequentially as above, the threshold voltage of the first transistor is compensated by the first capacitor in the threshold compensation stage and the data writing stage, and the duration of the threshold compensation stage can be adjusted according to the threshold voltage compensation time corresponding to the first transistor, to allow the control terminal of the first transistor to acquire a sufficient charging time. Compared with performing the threshold voltage compensation only in the data writing stage, according to the present embodiments, the compensation time can be effectively prolonged, improving the threshold voltage compensation effect of the first transistor. In the case where the first transistor is the N-type drive transistor having IGZO as channel layer, a good threshold voltage compensation effect can be achieved as well, and color deviation of the display panel can be avoided.

In some embodiments, with continued reference to FIG. 5, in the data writing stage t3, the sixth transistor M6 is turned off after being turned on; and the fourth transistor M4 is turned off after being turned on. In the data writing stage t3, after the first capacitor compensating the threshold voltage and the second capacitor storing the data voltage are completed, the sixth transistor M6 and the fourth transistor M4 are automatically turned off, such that there is a certain time interval between the compensation process performed by the capacitor and the subsequent light emitting stage, thereby avoiding fluctuation in the compensation process of the capacitor and further improving the compensation effect.

In some embodiments, the fourth transistor M4 is turned off after the sixth transistor M6 is turned off. In the data writing stage t3, when the sixth transistor M6 and the fourth transistor M4 are turned off after they are turned on, the fourth transistor M4 is turned off after the sixth transistor M6 is turned off, thus when the threshold voltage Vth is stored in the first capacitor C1, the sixth transistor M6 keeps being turned on to allow the fourth transistor M4 to write the data voltage Data to the second terminal of the first transistor M1, thereby ensuring that the potential Vg of the control terminal of the first transistor M1 meets Vg=Data+Vth. When the fourth transistor M4 is turned off and would not write the data voltage Data any longer, the sixth transistor M6 is then turned off, thereby ensuring the good compensation effect of the pixel circuit, avoiding the difference between the currents transmitted by the first transistors M1 (the drive transistors) due to the difference between the compensated threshold voltages, and improving the uniformity of the display panel.

Figure 10:
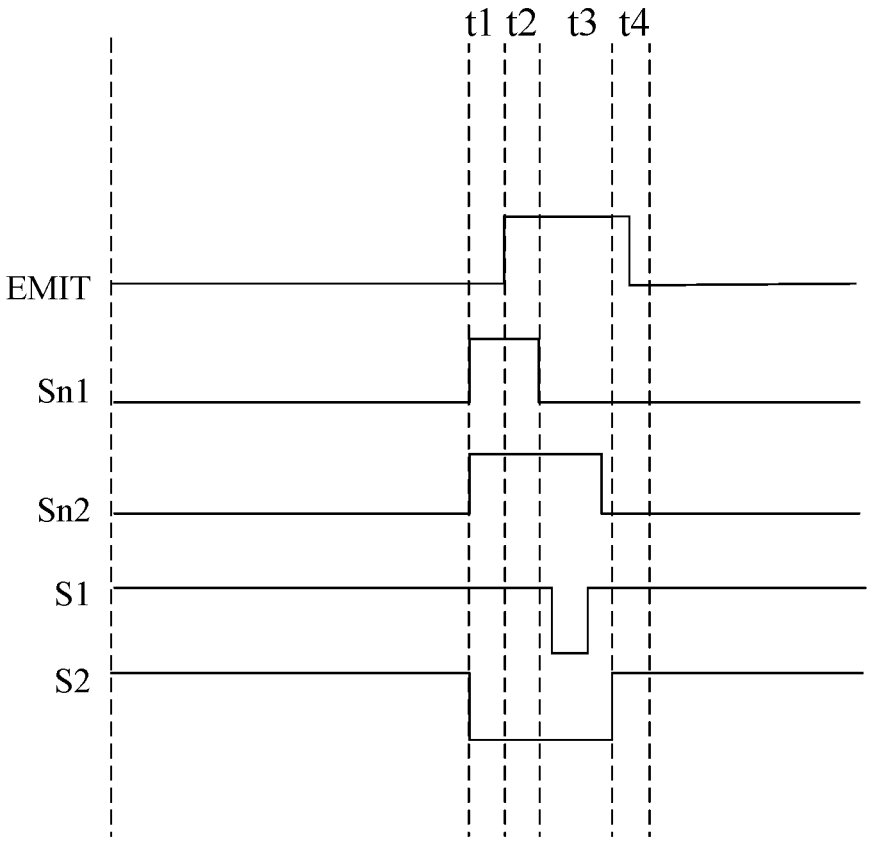
FIG. 10 is a schematic diagram of another operation timing sequence of the pixel circuit of FIG. 4 in one frame period.

FIG. 10 is a schematic diagram of another operation timing sequence of the pixel circuit of FIG. 4 in one frame period. In some embodiments, in the light emitting stage t4, the third transistor M3 is turned on after the fifth transistor M5 is turned off. In the light emitting stage t4, it is necessary to turn off the fifth transistor M5 first, to block the reset to the light emitting module by the reference voltage, and then turn on the third transistor M3 to drive the light emitting module to emit light through the first transistor M1, thereby effectively avoiding interference of the reference voltage to the light emitting stage and improving the display effect.

Figure 11:
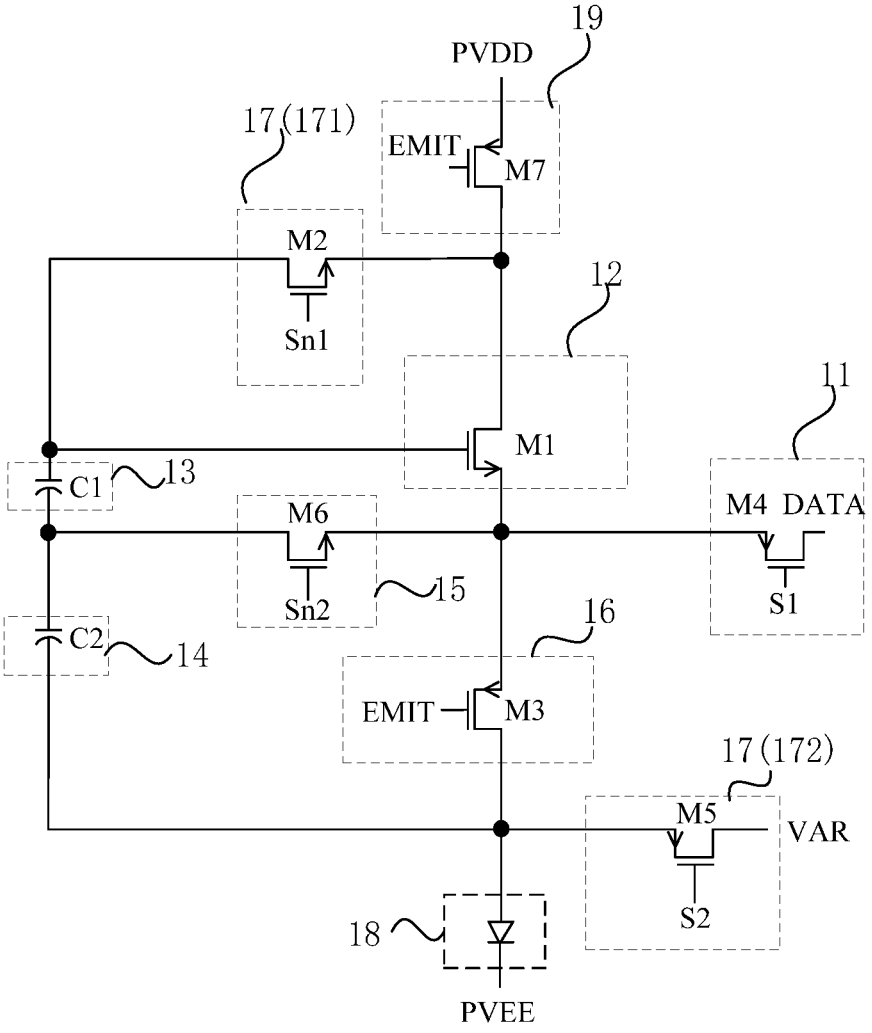
FIG. 11 is another schematic structural diagram of a pixel circuit according to an embodiment of the present disclosure.

FIG. 11 is another schematic structural diagram of a pixel circuit according to an embodiment of the present disclosure. In some embodiments, the pixel circuit may further include a second light emission control module 19, and the second light emission control module 19 is connected between the first power supply PVDD and the first terminal of the drive module 12. In the process of compensation to the control terminal of the first transistor M1, a situation may exist in which the compensation cannot be performed until the first transistor is turned off completely, and in this case the first power supply PVDD may always supply leakage current to the first transistor M1. Thus, in the present embodiments, the second light emission control module 19 is additionally provided, and the connection between the first power supply PVDD and the drive module 12 is cut off by the second light emission control module 19, such that no leakage current flows through the first transistor M1, which effectively avoids adverse effects caused by the first transistor M1 to the display due to that the first transistor M1 cannot be turned off completely.

In some embodiments, the control terminal of the second light emission control module 19 is connected to the light emission control signal line EMIT. The second light emission control module 19 and the first light emission control module 16 are both controlled by the light emission control signal line EMIT, therefore, the operation timing sequence of the second light emission control module 19 is consistent with that of the first light emission control module 16. When the first light emission control module 16 is connected to each of the first transistor M1 and the light-emitting module 18, the second light emission control module 19 is connected to each of the first power supply PVDD and the first transistor M1.

With continued reference to FIG. 11, in some embodiments, the second light emission control module 19 may include a seventh transistor M7. A first terminal of the seventh transistor M7 is electrically connected to the first power supply PVDD; and a second terminal of the seventh transistor M7 is electrically connected to each of the first initialization module 171 and the drive module 12. A control terminal of the seventh transistor M7 is connected to the light emission control signal line EMIT.

Figure 12:
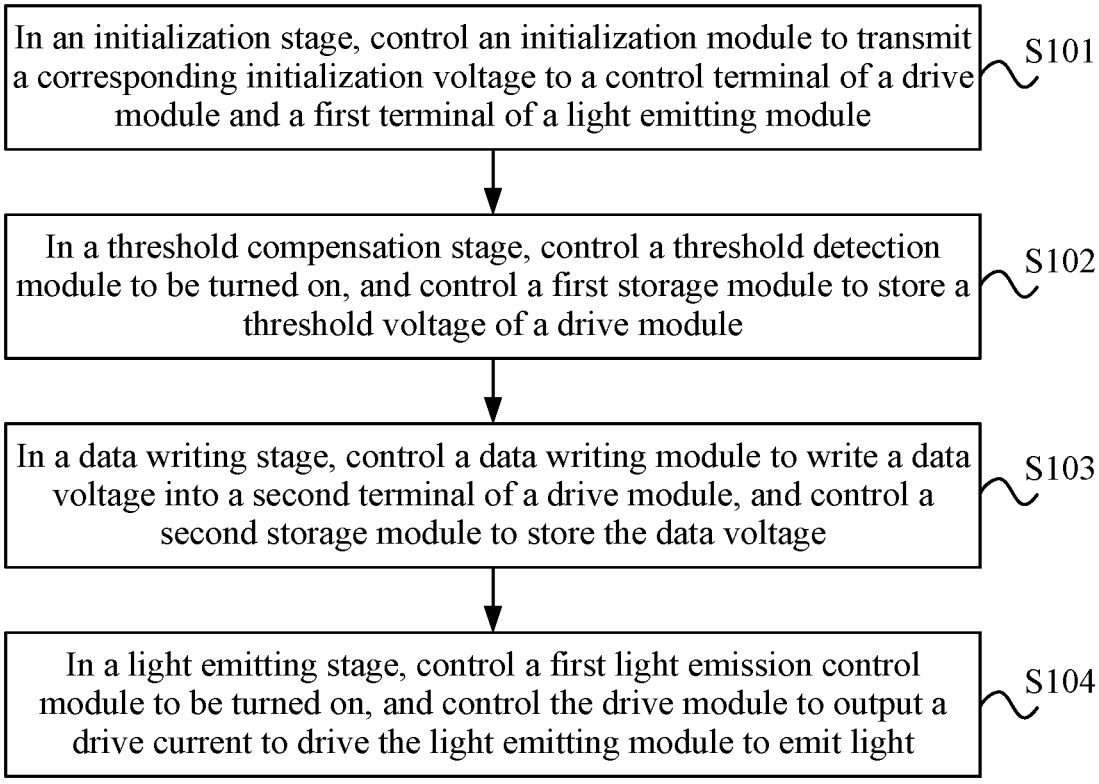
FIG. 12 is a schematic flowchart of a pixel circuit driving method according to an embodiment of the present disclosure.

A pixel circuit driving method is further provided according to embodiments of the present disclosure, which is applicable to the pixel circuit according to any embodiment of the present disclosure. FIG. 12 is a schematic flowchart of the pixel circuit driving method according to the embodiment of the present disclosure. As shown in FIG. 12, the method according to the present embodiments includes the following S101, S102, S103, and S104.

In S101: in an initialization stage, the initialization module is controlled to transmit a corresponding initialization voltage to the control terminal of the drive module and the first terminal of the light emitting module.

In S102: in a threshold compensation stage, the threshold detection module is controlled to turn on, and the first storage module is controlled to store the threshold voltage of the drive module.

In S103: in a data writing stage, the data writing module is controlled to writes a data voltage to the second terminal of the drive module; and the second storage module is controlled to store the data voltage.

In S104: in a light emitting stage, the first light emission control module is controlled to turn on, and the drive module is controlled to output a drive current to drive the light emitting module to emit light.

In embodiments of the present disclosure, the drive module is connected to the first power supply, and is connected to the first terminal of the light emitting module via the first light emission control module, and the second terminal of the light emitting module is connected to the second power supply, so that the drive module provides a light emission drive signal for the light emitting module; the initialization module is configured to provide corresponding initialization voltages to the control terminal of the drive module and the first terminal of the light emitting module; the first storage module is connected to the control terminal of the drive module, and is connected to the second terminal of the drive module via the threshold detection module, and can store the threshold voltage of the drive module before the data voltage is written into the drive module; the data writing module is connected to the second terminal of the drive module, and is configured to transmit the data voltage to the drive module; the second storage module is connected to each of the first storage unit module and the first terminal of the light emitting module, and is configured to store the data voltage of the drive module. In the present embodiments, the first storage module can store the threshold voltage before the data voltage is written into the drive module, so as to compensate the threshold voltage for the drive module in advance. In addition, the threshold voltage is kept being compensated while the data voltage is written into the drive module, and thus, a duration of compensation for the threshold voltage is effectively prolonged, the compensation effect is improved, the issue of different degrees of compensation for the threshold voltage between different pixels is effectively avoided, the drive module is prevented from transmitting different currents to the light emitting modules, thereby improving a uniformity of the display luminance of the entire display panel, and reducing the luminance deviation.

On the basis of the above-described embodiment, reference is made to FIG. 5 to FIG. 9, the initialization module includes a first initialization module and a second initialization module; the drive module includes a first transistor M1; the first initialization module includes a second transistor M2; the first light emission control module includes a third transistor M3; the data writing module includes a fourth transistor M4; the second initialization module includes a fifth transistor M5; the threshold detection module includes a sixth transistor M6; the first storage module includes a first capacitor C1; and the second storage module includes a second capacitor C2.

The pixel circuit driving method includes the following.

In an initialization stage, a first scanning signal controls the fourth transistor M4 to be turned off, a second scanning signal controls the fifth transistor M5 to be turned on, a light emission control signal controls the third transistor M3 to be turned on, a third scanning signal controls the second transistor M2 to be turned on, a fourth scanning signal controls the sixth transistor M6 to be turned on, a gate of the first transistor M1 obtains a first initialization voltage, the first terminal of the light emitting module obtains a second initialization voltage, and the first transistor M1 is turned on.

In a threshold compensation stage, the first scanning signal controls the fourth transistor M4 to be turned off, the second scanning signal controls the fifth transistor M5 to be turned on, the light emission control signal controls the third transistor M3 to be turned off, the third scanning signal controls the second transistor M2 to be turned on, the fourth scanning signal controls the sixth transistor M6 to be turned on, thus the first transistor M1 is turned on, a voltage difference between the control terminal of the first transistor M1 and the second terminal of the first transistor M1 is a threshold voltage; and the first capacitor C1 stores the threshold voltage.

In a data writing stage, the first scanning signal controls the fourth transistor M4 to be turned on, the second scanning signal controls the fifth transistor M5 to be turned on, the light emission control signal controls the third transistor M3 to be turned off, the third scanning signal controls the second transistor M2 to be turned off, the fourth scanning signal controls the sixth transistor M6 to be turned on, thus the first transistor M1 is turned on, and a data voltage is written into the second terminal of the first transistor M1; and the second capacitor C2 stores the data voltage.

In a light emitting stage, the first scanning signal controls the fourth transistor M4 to be turned off, the second scanning signal controls the fifth transistor M5 to be turned off, the light emission control signal controls the third transistor M3 to be turned on, the third scanning signal controls the second transistor M2 to be turned off, the fourth scanning signal controls the sixth transistor M6 to be turned off, and the first transistor M1 outputs a drive current to the light emitting module through the third transistor M3.

Figure 13:
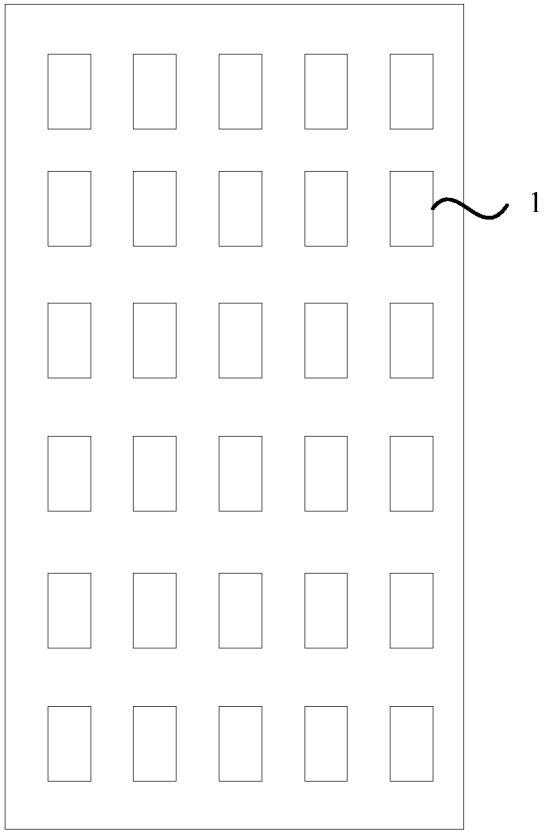
FIG. 13 is a schematic structural diagram of a display panel according to an embodiment of the present disclosure.

A display panel is further provided according to embodiments of the present disclosure. FIG. 13 is a schematic structural diagram of the display panel according to the embodiment of the present disclosure. As shown in FIG. 13, the display panel according to the embodiment of the present disclosure includes the pixel circuit 1 according to any embodiment of the present disclosure. The display panel in the present embodiments includes technical features of the pixel circuit according to any embodiment of the present disclosure, and has the advantageous effects of the corresponding technical features, the details of which are not repeated herein.

Figure 14:
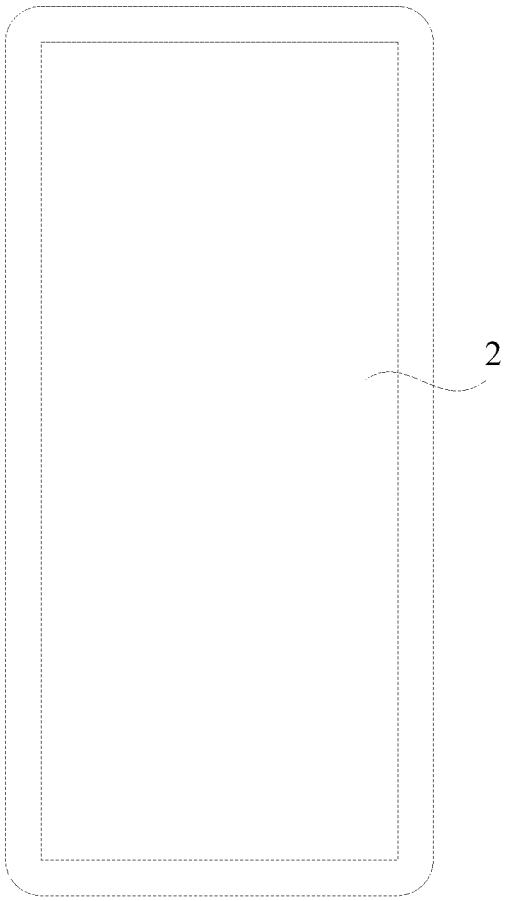
FIG. 14 is a schematic structural diagram of a display apparatus according to an embodiment of the present disclosure.

A display apparatus is further provided according to embodiments of the present disclosure. FIG. 14 is a schematic structural diagram of the display apparatus according to the embodiment of the present disclosure. As shown in FIG. 14, the display apparatus according to the embodiment of the present disclosure includes the display panel 2 according to any embodiment of the present disclosure. The display apparatus may be a mobile phone as shown in FIG. 14, or may be a computer, a television, an intelligent wearable device, or the like, which is not particularly limited in the present embodiments.

It is to be noted that the above are merely preferred embodiments of the present disclosure and technical principles used therein. It will be understood by those skilled in the art that the present disclosure is not limited to the embodiments described herein. Those skilled in the art can make various apparent modifications, adaptations, and substitutions without departing from the scope of the present disclosure. Therefore, while the present disclosure has been described in detail through the above-mentioned embodiments, the present disclosure is not limited to the above-described embodiments and may include more other equivalent embodiments without departing from the concept of the present disclosure. The scope of the present disclosure is determined by the scope of the appended claims.

What is claimed is:

1. A pixel circuit, comprising a data writing module, a drive module, a first storage module, a second storage module, a threshold detection module, a first light emission control module, an initialization module and a light emitting module; wherein, a first terminal of the drive module is configured to receive a signal output by a first power supply, the first light emission control module is connected between a second terminal of the drive module and a first terminal of the light emitting module, and a second terminal of the light emitting module is connected to a second power supply; the drive module is configured to provide a light mission drive signal to the light emitting module;

a first terminal of the first storage module is connected to a control terminal of the drive module, a second terminal of the first storage module is connected to a first terminal of the second storage module, and a second terminal of the second storage module is connected to the first terminal of the light emitting module;

the threshold detection module is connected between the second terminal of the first storage module and the second terminal of the drive module, and the threshold detection module is configured to control the first storage module to store a threshold voltage of the drive module;

the data writing module is connected to the second terminal of the drive module, and the data writing module is configured to transmit a data voltage to the drive module; and the initialization module is connected to the control terminal of the drive module and the first terminal of the light emitting module, and the initialization module is configured to transmit a corresponding initialization voltage to the control terminal of the drive module and the first terminal of the light emitting module.

2. The pixel circuit according to claim 1, wherein the initialization module comprises a first initialization module and a second initialization module;

the first initialization module is connected between the first power supply and the first terminal of the first storage module, and the first initialization module is configured to provide a first initialization voltage to the first storage module; and the second initialization module is connected between a reference voltage and the first terminal of the light emitting module, and the second initialization module is configured to provide a second initialization voltage to the light emitting module and the second terminal of the drive module.

3. The pixel circuit according to claim 2, wherein a control terminal of the data writing module is connected to a first scanning line; a control terminal of the second initialization module is connected to a second scanning line; and a control terminal of the first light emission control module is connected to a light emission control signal line; and wherein a control terminal of the first initialization module is connected to a third scanning line; and a control terminal of the threshold detection module is connected to a fourth scanning line.

4. The pixel circuit according to claim 3, wherein in one frame period, a pulse of a signal transmitted on the first scanning line, a pulse of a signal transmitted on the light emission control signal line, a pulse of a signal transmitted on the third scanning line, and a pulse of a signal transmitted on the fourth scanning line are all within a time interval of a pulse of a signal transmitted on the second scanning line.

5. The pixel circuit according to claim 2, wherein the drive module comprises a first transistor; the first initialization module comprises a second transistor; the first light emission control module comprises a third transistor; the data writing module comprises a fourth transistor; the second initialization module comprises a fifth transistor; the threshold detection module comprises a sixth transistor; and the first storage module comprises a first capacitor; and the second storage module comprises a second capacitor;

a control terminal of the first transistor is electrically connected to each of a second terminal of the second transistor and a first terminal of the first capacitor; a first terminal of the first transistor is configured to receive a signal output from the first power supply PVDD; and a second terminal of the first transistor is connected to each of a second terminal of the sixth transistor, a first terminal of the third transistor and a second terminal of the fourth transistor;

a first terminal of the second transistor is configured to receive a signal output from the first power supply PVDD; a control terminal of the second transistor is connected to a third scanning line; a second terminal of the first capacitor is electrically connected to a first terminal of the sixth transistor; and a control terminal of the sixth transistor is connected to a fourth scanning line;

a first terminal of the fourth transistor is connected to a data signal line; a control terminal of the fourth transistor is connected to a first scanning line; a second terminal of the third transistor is connected to the first terminal of the light emitting module; a control terminal of the third transistor is connected to a light emission control signal line; a first terminal of the fifth transistor is connected to the reference voltage; a second terminal of the fifth transistor is connected to the first terminal of the light emitting module; and a control terminal of the fifth transistor is connected to a second scanning line; and a first terminal of the second capacitor is electrically connected to the second terminal of the first capacitor; and a second terminal of the second capacitor is connected to the first terminal of the light emitting module.

6. The pixel circuit according to claim 5, wherein the first transistor, the second transistor, and the sixth transistor are N-type transistors; the fourth transistor, the fifth transistor and the third transistor are P-type transistors.

7. The pixel circuit according to claim 5, wherein the first scanning line, the second scanning line, the third scanning line, and the fourth scanning line are configured to implement driving as follows:

in an initialization stage, the first transistor, the second transistor, the third transistor, the fifth transistor, and the sixth transistor are turned on, and the fourth transistor is turned off;

in a threshold compensation stage, the first transistor, the second transistor, the fifth transistor, and the sixth transistor are turned on, and the third transistor and the fourth transistor are turned off;

in a data writing stage, the first transistor, the fourth transistor, the fifth transistor, and the sixth transistor are turned on, and the second transistor and the third transistor are turned off; and in a light emitting stage, the first transistor and the third transistor are turned on, and the second transistor, the fourth transistor, the fifth transistor, and the sixth transistor are turned off.

8. The pixel circuit according to claim 7, wherein in the data writing stage, the sixth transistor is turned off after being turned on; and the fourth transistor is turned off after being turned on.

9. The pixel circuit according to claim 8, wherein the fourth transistor is turned off after the sixth transistor is turned off.

10. The pixel circuit according to claim 7, wherein in the light emitting stage, in the light emitting stage, the third transistor is turned on after the fifth transistor is turned off.

11. The pixel circuit according to claim 2, further comprising a second light emission control module; and the second light emission control module is connected between the first power supply and the first terminal of the drive module.

12. The pixel circuit according to claim 11, wherein a control terminal of the second light emission control module is connected to a light emission control signal line.

13. The pixel circuit according to claim 11, wherein the second light emission control module comprises a seventh transistor; and a first terminal of the seventh transistor is electrically connected to the first power supply; a second terminal of the seventh transistor is electrically connected to each of the first initialization module and the drive module; and a control terminal of the seventh transistor is connected to a light emission control signal line.

14. The pixel circuit according to claim 1, wherein the first terminal of the drive module is directly connected to the first power supply.

15. A pixel circuit driving method, applied to a pixel circuit, wherein the pixel circuit comprising a data writing module, a drive module, a first storage module, a second storage module, a threshold detection module, a first light emission control module, an initialization module and a light emitting module;

a first terminal of the drive module is configured to receive a signal output by a first power supply, the first light emission control module is connected between a second terminal of the drive module and a first terminal of the light emitting module, and a second terminal of the light emitting module is connected to a second power supply; the drive module is configured to provide a light mission drive signal to the light emitting module;

a first terminal of the first storage module is connected to a control terminal of the drive module, a second terminal of the first storage module is connected to a first terminal of the second storage module, and a second terminal of the second storage module is connected to the first terminal of the light emitting module;

the threshold detection module is connected between the second terminal of the first storage module and the second terminal of the drive module, and the threshold detection module is configured to control the first storage module to store a threshold voltage of the drive module;

the data writing module is connected to the second terminal of the drive module, and the data writing module is configured to transmit a data voltage to the drive module; and the initialization module is connected to the control terminal of the drive module and the first terminal of the light emitting module, and the initialization module is configured to transmit a corresponding initialization voltage to the control terminal of the drive module and the first terminal of the light emitting module; and wherein the method comprises:

in an initialization stage, controlling the initialization module to transmit a corresponding initialization voltage to the control terminal of the drive module and the first terminal of the light emitting module;

in a threshold compensation stage, controlling the threshold detection module to be turned on, and controlling the first storage module to store a threshold voltage of the drive module;

in a data writing stage, controlling the data writing module to write a data voltage into the second terminal of the drive module, and controlling the second storage module to store the data voltage; and in a light emitting stage, controlling the first light emission control module to be turned on, and controlling the drive module to output a drive current to drive the light emitting module to emit light.

16. The pixel circuit driving method according to claim 15, wherein the initialization module comprises a first initialization module and a second initialization module; the drive module comprises a first transistor; the first initialization module comprises a second transistor; the first light emission control module comprises a third transistor; the data writing module comprises a fourth transistor; the second initialization module comprises a fifth transistor; the threshold detection module comprises a sixth transistor; the first storage module comprises a first capacitor; the second storage module comprises a second capacitor; and wherein the pixel circuit driving method comprises:

in an initialization stage, controlling, by a first scanning signal, the fourth transistor to be turned off; controlling, by a second scanning signal, the fifth transistor to be turned on; controlling, by the light emission control signal, the third transistor to be turned on; controlling, by the third scanning signal, the second transistor to be turned on; controlling, by a fourth scanning signal, the sixth transistor to be turned on; obtaining, by a gate of the first transistor, a first initialization voltage; obtaining, by the first terminal of the light emitting module, a second initialization voltage, and turning on, the first transistor;

in a threshold compensation stage, controlling, by the first scanning signal, the fourth transistor to be turned off; controlling, by the second scanning signal, the fifth transistor to be turned on; controlling, by the light emission control signal, the third transistor to be turned off; controlling, by the third scanning signal, the second transistor to be turned on; controlling, by the fourth scanning signal, the sixth transistor to be turned on, so that the first transistor is turned on, a voltage difference between the control terminal of the first transistor and the second terminal of the first transistor is a threshold voltage, and the first capacitor stores the threshold voltage;

in a data writing stage, controlling, by the first scanning signal, the fourth transistor to be turned on; controlling, by the second scanning signal, the fifth transistor to be turned on; controlling, by the light emission control signal, the third transistor to be turned off; controlling, by the third scanning signal, the second transistor to be turned off; controlling, by the fourth scanning signal, the sixth transistor to be turned on, so that the first transistor is turned on, a data voltage is written into the second terminal of the first transistor; and the second capacitor stores the data voltage; and in a light emitting stage, controlling, by the first scanning signal, the fourth transistor to be turned off; controlling, by the second scanning signal, the fifth transistor to be turned off; controlling, by the light emission control signal, the third transistor to be turned on; controlling, by the third scanning signal, the second transistor to be turned off; controlling, by the fourth scanning signal, the sixth transistor to be turned off; and outputting, by the first transistor, a drive current to the light emitting module through the third transistor.

17. A display panel, comprising a pixel circuit, wherein the pixel circuit comprises a data writing module, a drive module, a first storage module, a second storage module, a threshold detection module, a first light emission control module, an initialization module and a light emitting module;

a first terminal of the drive module is configured to receive a signal output by a first power supply, the first light emission control module is connected between a second terminal of the drive module and a first terminal of the light emitting module, and a second terminal of the light emitting module is connected to a second power supply; the drive module is configured to provide a light mission drive signal to the light emitting module;

a first terminal of the first storage module is connected to a control terminal of the drive module, a second terminal of the first storage module is connected to a first terminal of the second storage module, and a second terminal of the second storage module is connected to the first terminal of the light emitting module;

the threshold detection module is connected between the second terminal of the first storage module and the second terminal of the drive module, and the threshold detection module is configured to control the first storage module to store a threshold voltage of the drive module;

the data writing module is connected to the second terminal of the drive module, and the data writing module is configured to transmit a data voltage to the drive module; and the initialization module is connected to the control terminal of the drive module and the first terminal of the light emitting module, and the initialization module is configured to transmit a corresponding initialization voltage to the control terminal of the drive module and the first terminal of the light emitting module.

18. A display apparatus, comprising the display panel according to claim 17.

19. The display panel according to claim 17, wherein the initialization module comprises a first initialization module and a second initialization module;

the first initialization module is connected between the first power supply and the first terminal of the first storage module, and the first initialization module is configured to provide a first initialization voltage to the first storage module; and the second initialization module is connected between a reference voltage and the first terminal of the light emitting module, and the second initialization module is configured to provide a second initialization voltage to the light emitting module and the second terminal of the drive module.

20. The display panel according to claim 17, wherein the first terminal of the drive module is directly connected to the first power supply.

* * * * *